United States Patent [19]

Jansz

[11] 4,362,216

[45] Dec. 7, 1982

[54] PILE DRIVING APPARATUS

[75] Inventor: Joost W. Jansz, The Hague, Netherlands

[73] Assignee: Hollandsche Beton Groep N.V., Rijswijk, Netherlands

[21] Appl. No.: 846,563

[22] Filed: Oct. 28, 1977

[30] Foreign Application Priority Data

Nov. 2, 1976 [GB] United Kingdom ..... 45592/76

[51] Int. Cl.[2] ..... B25D 9/00

[52] U.S. Cl. ..... 173/131; 173/139

[58] Field of Search ..... 61/53.5; 173/1, 128, 173/131, 133, 139, 162; 267/137

[56] References Cited

U.S. PATENT DOCUMENTS

| | | | |
|---|---|---|---|
| 873,517 | 12/1907 | De Witt | 173/131 |
| 3,417,828 | 12/1968 | Duyster et al. | 61/53.5 X |
| 3,498,391 | 3/1970 | Guild et al. | 173/131 |
| 3,797,585 | 3/1974 | Ludvigson | 173/1 X |
| 3,975,918 | 8/1976 | Jansz | 61/53.5 |
| 3,991,833 | 11/1976 | Ruppert | 173/131 X |
| 4,029,158 | 6/1977 | Gerrish | 173/139 X |
| 4,043,405 | 8/1977 | Kuhn | 173/133 X |

FOREIGN PATENT DOCUMENTS

| | | | |
|---|---|---|---|
| 55630 | 5/1967 | German Democratic Rep. | 173/162 |
| 47-24502 | 7/1972 | Japan | 173/1 |
| 1168547 | 10/1969 | United Kingdom . | |

*Primary Examiner*—Lawrence J. Staab

*Attorney, Agent, or Firm*—Brisebois & Kruger

[57] ABSTRACT

A method of and apparatus for driving piles by the impact force delivered by a hammer disposed in a housing from the bottom end of which there extends downwardly a pile sleeve in which a pile anvil is held captive, in which shock absorbing means separate from the hammer are interposed between the bottom end of the housing and the pile anvil for absorbing rebounce forces reaching the top of the pile of lower magnitude to that of the impact force.

A pile driving apparatus constructed according to another aspect of the invention comprises a hammer and resilient means in the path of travel of the hammer for transmitting the impact force of the hammer to a pile, and stop means for cutting out the resilient effect of the resilient means on the impact force by delivering a non-resilient blow to the pile.

7 Claims, 16 Drawing Figures

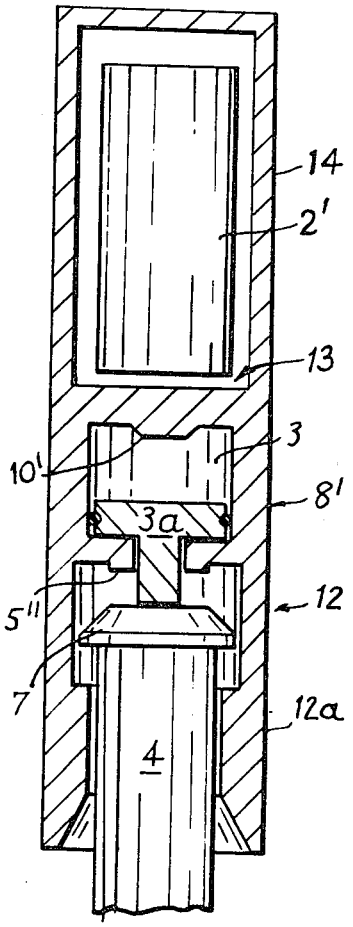
Fig.12
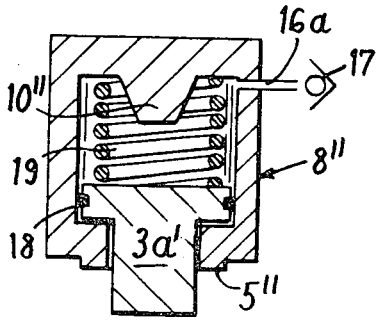
Fig.14
Fig.13
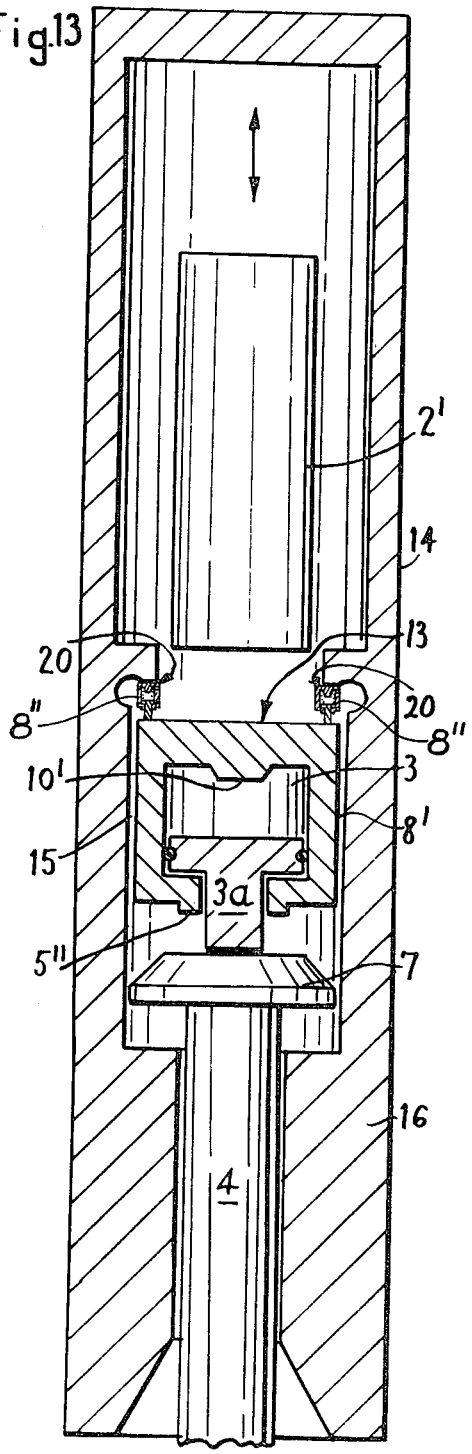

PILE DRIVING APPARATUS

BACKGROUND OF THE INVENTION

1. Field of the Invention

This invention relates to apparatus for driving piles by the stroke of a hammer in the form of a ram or drop-weight.

2. Description of the Prior Art

The specification of British Pat. No. 1,168,547 describes a pile driving apparatus which has resilient impact transmitting buffer means in the path of travel of the hammer for transmitting the impact of the hammer stroke to a pile, conveniently through a pile cap or anvil on the top of the pile. The resilient impact transmitting buffer means comprises precompressed gas in a closed chamber and the stroke energy of the hammer in transmitted via the gas and a strike cap to the pile, the strike cap being supported in, and projecting from the chamber. The precompressed gas is further compressed on impact enabling the minimum force required to overcome the ground resistance, which opposes penetration of the pile, to be directly available under the impact, and smoothing out force peaks so that the maximum impact force does not exceed the force which causes damage to the pile.

SUMMARY OF THE INVENTION

According to one aspect, the present invention consists in a pile driving apparatus of the type disclosed in British Pat. No. 1,168,547, wherein the pressure of the gas and/or the arrangement of the parts is such that the hammer also delivers a rigid or non-resilient blow via the wall means defining the chamber and/or the strike cap piston during each impact stroke. For example, the gas pressure or stem length of the strike cap piston may be so chosen that the non-resilient impact is provided by the hammer directly striking the pile, or striking the pile through a wall of the chamber or through the strike cap piston striking a wall of the chamber.

In this manner a momentary peak force is delivered by the hammer during each impact.

By means of the invention the pile can be subjected to a peak force at a selected period of time when needed and since the resilient impact during which the strike piston hits the pile at a relatively lower impact force, enables the moving parts of the pile driving apparatus and the top of the pile to be gently brought together and reduces any misalignment of the pile before the non-resilient impact, damage to the pile from the higher peak force of the non-resilient impact is minimised or prevented.

The chamber wall means or the combination therewith of the strike piston constitute a stop means which cuts out the effect of the resilient means on the impact force after a predetermined interval of time by delivering the non-resilient blow.

The precompressed resilient means may be incorporated in the hammer itself or in a separate body as described in our aforementioned British Patent Specification.

Another aspect of the present invention is concerned with the well known commonly referred to phenonomen of "rebounce" which is the force wave reflected from the bottom of the pile after each impact. In heavy pile driving, for example in offshore pile driving, where extremely large units are used to drive very large diameter tubular piles into the sea bed, the rebounce force may be excessive and cause damage to the pile driving equipment on the top of the pile.

By selecting an appropriate gas pressure for the resilient impact transmitting buffer means, a pile driving apparatus of the type described in our British Pat. No. 1,168,547 may be used to drive relatively short piles without damaging the hammer, since the hammer is still actively working at the top of the pile at the moment when the reflected force wave reaches the pile top and therefore the resilient means can absorb the rebounce forces. However, with the very long piles used in offshore practice, by the time the reflected force wave reaches the pile top, the hammer is no longer actively working at the pile top and thus the rebounce forces can damage the hammer housing.

Accordingly, from another aspect, the present invention consists in providing, in pile driving apparatus having a housing which rests on the top of a pile during pile driving, shock absorbing means separate from the hammer and interposed between the housing and the top of the pile. In this way, the rebounce forces generated in very long piles may be absorbed thereby minimizing or preventing damage to the hammer housing.

The invention also consists in a method of driving a pile in which the rebounce forces reaching the top of the pile are absorbed in such shock absorbing means, the shock absorbing means providing a resistive shock absorbing force of a magnitude which is less than that of the impact force delivered by the hammer.

The shock absorbing means may be constituted by resilient means such as described in our British Pat. No. 1,168,547. The resilient means is incorporated in a separate body which supports the hammer housing at least during the rebounce period and the gas pressure is chosen so as to absorb the rebounce forces. In order that sufficient driving force may be delivered to the pile the gas pressure and/or the arrangement of the parts may be such that the hammer also delivers a rigid blow via the chamber walls and/or the strike cap during each impact stroke, for example in any of the ways described above.

Alternatively, or in addition, the shock absorbing means may comprise resilient means interposed between the housing and the said separate body. In another embodiment the shock absorbing means comprises a plurality of shock absorbing devices each comprising resilient material which is held in compression against the bottom end of the housing.

In order that the invention may be more clearly understood, reference will now be made to the accompanying drawings, in which:

BRIEF DESCRIPTION OF THE DRAWINGS

FIG. 14 is a section of another form of resilient means.

DESCRIPTION OF THE PREFERRED EMBODIMENTS

Figure 1:
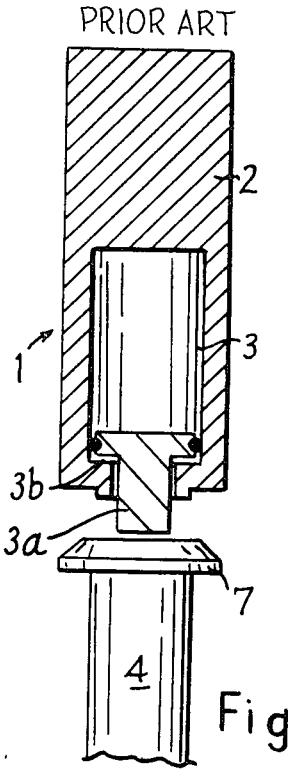
FIG. 1 is a section through a part of a simplified form of the pile driving apparatus incorporating resilient means described in our British Pat. No. 1,168,547 and positioned above the top of a pile.
Figure 2:
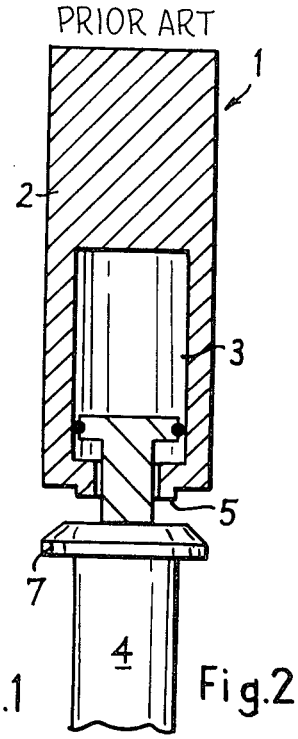
FIG. 2 is a similar view to that of FIG. 1 but showing a part of the hammer in a different position.

FIG. 1 shows a hammer in the form of a dropweight 1 of a simplified form of the pile driving apparatus described in our British Pat. No. 1,168,547. In a part 2 of the dropweight is incorporated the precompressed resilient impact transmitting buffer means comprising a gas compressed in a chamber 3 which is closed at its lower end by a strike cap piston 3*a* for delivering an impact to a pile 4 through a pile cap or anvil 7 on the top of the pile. The strike cap piston 3*a* normally rests against a shoulder 3*b* on the bottom wall of the chamber 3. FIG. 2 shows the position of the dropweight 1 after it has delivered an impact to the pile 4 through the strike cap piston 3*a* from which it can be seen that the lower projecting end 5 of the dropweight part 2 does not contact the anvil 7.

Figure 3:
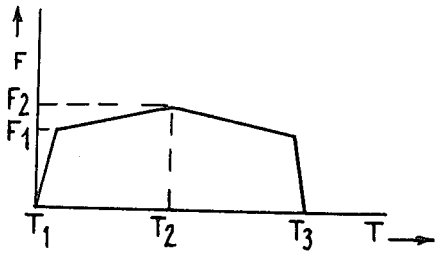
Fig.3 (PRIOR ART)
FIG. 3 is a time/impact force diagram obtained when using the apparatus of FIG. 1.

The stroke diagram of the pile driving apparatus shown in FIGS. 1 and 2 may be represented schematically as shown in FIG. 3. At the moment $T_1$, the dropweight 1 hits the pile or anvil and immediately force $F_1$ imparted by the precompressed gas through the strike cap piston actively works on the pile. The dropweight part 2 continues its downward movement as illustrated in FIG. 3 until its velocity has reached zero which is at the time $T_2$ on the diagram where the force has only gradually increased to a value $F_2$. The dropweight part 2 then moves upwards again because of the gas pressure in the chamber 3. At the moment $T_3$ the "buffer closes", i.e. the strike cap piston returns to the position shown in FIG. 1, and the force is suddenly taken off the pile. As described in our aforementioned British Patent Specification, the gas is precompressed to such an extent that under the impact the minimum force exceeding the ground resistance is directly available. Thus the pressure of the gas can be brought into the order of the ground resistance.

Figure 4:
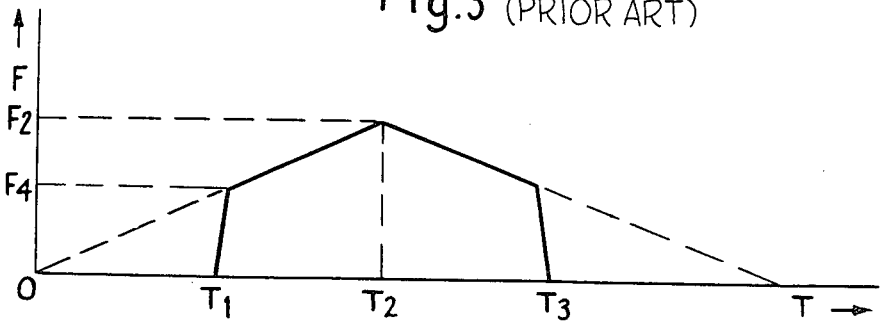
Fig.4 (PRIOR ART)
FIG. 4 is a total time/impact force diagram of which the diagram of FIG. 3 forms a part.

The diagram of FIG. 3, in fact, can be looked upon as a part of a total time/stroke impact force diagram which is shown in FIG. 4 and which resembles the force/compression graph of a spring where the elasticity curve starts at zero where compression is nil at zero force. The curve, which for simplicity's sake is shown here as a straight line, represents the elasticity curve of the spring. Since the spring is precompressed, this means that the part of the diagram, 0-$T_1$ in FIG. 4 remains inactive. As will be appreciated from our aforementioned British Patent Specification, the degree or value of the gas pressure in the chamber 3 is chosen such that the total weight of the dropweight part 2 does not contact the anvil 7 or pile 4 as is shown in FIG. 2.

In accordance with one aspect of the invention, before the downward velocity of the dropweight has reached its zero value, the dropweight part 2 hits the anvil 7 or pile 4 at its lower end 5 in steel-to-steel fashion so that the dropweight also delivers a rigid or non-resilient blow via the lower end 5 of the dropweight during each impact stroke.

Figure 5:
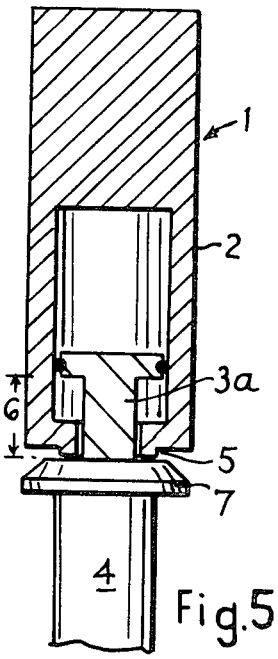
FIG. 5 is a section through a part of a simplified form of pile driving apparatus according to the invention, having resilient means incorporated in the hammer and being positioned above the top of a pile.

This may be achieved according to a feature of this invention either by choosing a shorter stem length 6 (see FIG. 5) for the strike cap piston 3*a* or a lower gas pressure in the chamber 3. In this case, the time/impact force diagram changes from that shown in FIG. 3 and is as represented schematically in FIG. 6. Referring to FIG. 6, again at the moment $T_1$, force $F_1$ becomes immediately active on the top of the pile. From moments $T_1$ to $T_4$ the elasticity curve of the spring is followed. During the downward movement of the dropweight part 2, its lower end 5 hits the anvil 7 at the moment $T_4$ causing an uncontrolled steel-to-steel impact peak force to occur of magnitude $F_4$. This peak force quickly falls back to a force level indicated at $F_3$ at the moment $T_5$ and from moments $T_5$ to $T_6$ the elasticity curve shown in FIG. 3 is followed until the "buffer closes" at the moment $T_6$. Since the peak force is momentary, damage to the pile is minimized or avoided.

Figure 6:
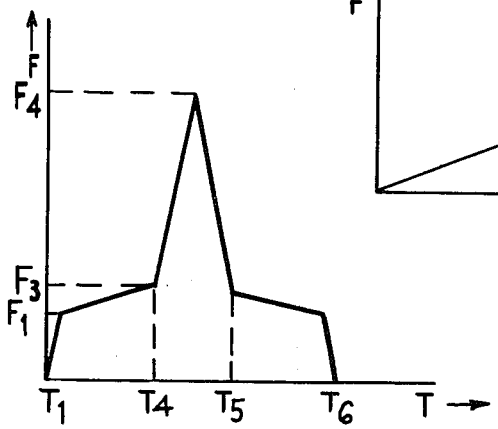
FIG. 6 is a time/impact force diagram obtained using the apparatus of FIG. 5.
Figure 7:
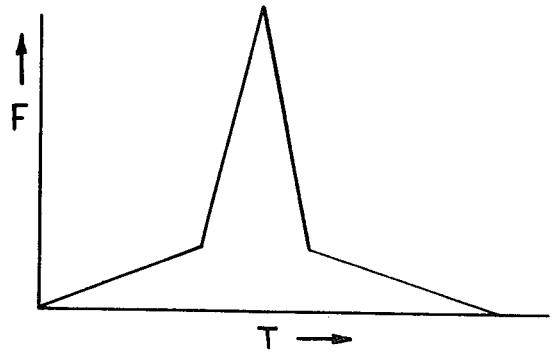
FIG. 7 is a total time/impact force diagram of which the diagram of FIG. 6 forms a part.

As in the case of FIG. 3, the diagram of FIG. 6 is part of a total force stroke impact diagram which is shown in FIG. 7 where zero represents the nil force at zero time (equal to no precompression of the gas in the chamber 3).

Figure 8:
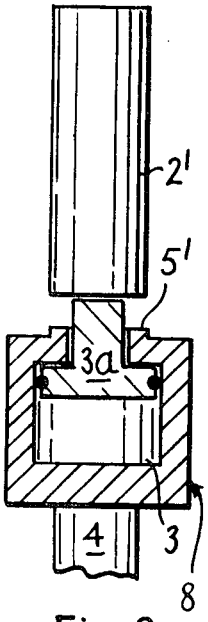
FIGS. 8 and 9 are sections of another embodiment showing the hammer in two positions respectively, and in which the resilient means are incorporated in a separate body.
Figure 9:
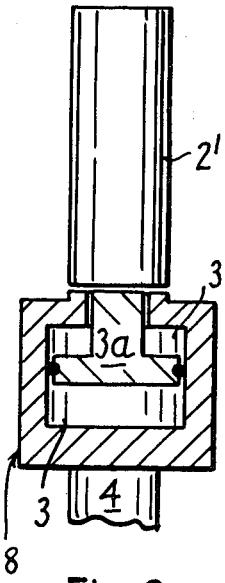

FIGS. 8 to 11 show embodiments in which the precompressed resilient means is incorporated in a separate body 8 instead of in the dropweight which can be in the form of a simple solid body 2'. In FIGS. 8 and 9, the separate body 8 is arranged directly on top of the pile 4 and therefore serves as an anvil instead of the anvil 7. The separate body 8 has an upwardly projecting part 5' on the top wall of the chamber 3, similar to the lower end 5 of the dropweight part 2 of the embodiment of FIG. 5 and the pressure of the gas in the chamber 3 is of such a value that the dropweight 2' strikes the part 5' in steel-to-steel fashion thereby delivering a rigid or non-resilient blow to the pile. The stroke diagram of the embodiment of FIGS. 8 and 9 is identical to that shown in FIG. 6.

Figure 10:
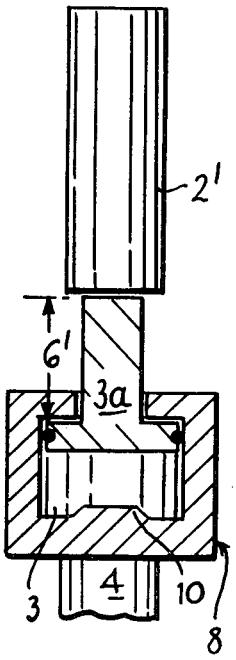
FIGS. 10 and 11 are sections of a modification of the embodiment of FIGS. 8 and 9, FIGS. 12 and 13 are sections of other embodiments.
Figure 11:
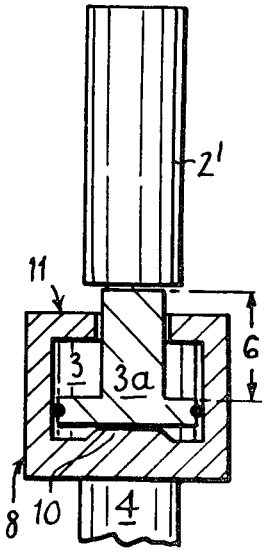

The modification shown in FIGS. 10 and 11 differs from FIGS. 8 and 9 in that the steel-to-steel impact does not occur at the part 5' but at an upwardly projecting interior part 10 on the bottom wall of the chamber 3. In this case, and as will be apparent from FIG. 11, the stem length 6' of the strike cap piston 3*a* is increased and is of such a length that the dropweight 2' can never touch the top wall 11 of the body 8. Again, the stroke diagram is as depicted in FIGS. 6 and 7.

The embodiment shown in FIG. 12 also comprises a separate body 8' but, in contrast to the separate body 8 of FIGS. 8 to 11, the separate body 8' is incorporated at the upper end of a downwardly extending tubular extension 12 of a housing 14 for the dropweight 2' and is inverted so that an anvil 7 is required on top of the pile 4. The extension 12 which has a recess in which the pile cap or anvil 7 is held captive also includes a tubular guide portion or pile sleeve 12*a* which serves to guide the pile driving apparatus onto and receives the top of the pile without any other means of support or guidance being required. Thus the dropweight 2' delivers the initial impact to the top wall, as illustrated, 13 of the body 8' and thus through the strike cap piston 3a to the anvil 7. The higher peak force impact is provided by having such a gas pressure in the chamber 3 or stem length of the piston 4 that the part 5'' of the separate body strikes the anvil 7 in steel-to-steel fashion. Alternatively, the higher peak force impact may be provided by increasing the stem length of the strike cap piston 3a and providing the interior wall of the chamber 3 with a projecting part 10' in a similar manner to the embodiment of FIGS. 10 and 11 such that the strike cap piston hits the projecting part.

A disadvantage of the construction of FIG. 12 is that the impact forces are transmitted directly to parts of the apparatus other than the separate body 8' in which the precompressed resilient means is incorporated.

This disadvantage is avoided in the embodiment of FIG. 13 in which the separate body 8' serves the sole purpose of transmitting the force during impact to the pile without affecting any other part of the construction. The dropweight 2' moves within a housing 14 from the bottom of which there extends downwardly a tubular portion having a recess 15 in which the anvil 7 is held captive and including a pile sleeve 16 for guiding the apparatus onto and receiving the top of the pile 4. The body 8' can move freely in the recess 15.

The housing and dropweight are not subjected at all to the impact forces arising from the impact of the dropweight 2' with the top wall 13 of the body 8'. The gas pressure in the chamber 3 and/or the arrangement of parts may be such that a momentary peak force is delivered in any of the ways mentioned previously with respect to FIG. 12.

With the above described embodiments a completely different purpose can be served. A well known aspect of heavy pile driving, for instance in offshore practice with large hammers and large diameter piles of greater lengths is the so-called "rebounce". Due to the impact a force-wave travels into the pile. At the toe of the pile part of that force-wave travels backwards up into the pile. At the top of the pile this force-wave hits the lower part of the hammer very often causing damage to the hammer, when no precautions have been taken. As long as the hammer with a built-in resilient impact transmitting buffer means is still actively working on top of the pile at the moment that this back traveling wave reaches the pile top the resilient means of body 8' are there to accept these "rebounce" forces in a proper way, avoiding damage to the hammer. In offshore practice however the piles are so long that the dropweight is no longer working on the pile at the moment that the "rebounce" force becomes active at the pile top, the resilient body 8' is not always properly working, depending on its prestressing value.

Where in British Pat. No. 1,168,547 the value of the resilience is in the order of the ground resistances to serve the purpose of penetration of the pile into the ground, the rebounce forces that must be compensated in the hammer are related to the total weight of the hammer, being generally only a fraction of the ground resistance force. For a big offshore hammer of say 100 metric tons net energy per blow these forces may respectively be in the order of 4000 tons and 200 tons respectively.

A construction of FIG. 13 may serve both purposes. When the gas pressure in the chamber 3 is chosen at such a value that the separate body 8' absorbs the rebounce force (lower magnitude) then it can also serve the purpose of transmitting the impact force at the moment the dropweight 2' hits because the gas pressure is such that it allows the part 5'' to hit the anvil 7 in a steel-to-steel fashion thereby delivering a rigid or non-resilient blow to the pile. The stroke diagram in this case is as in FIG. 6. It should be appreciated that in order to ensure that the rebounce forces are absorbed to a full extent by means of a low pressure in the chamber 3, the impact effect can only be served by arranging for a non-resilient blow to be delivered to the pile, e.g. by the part 5'' hitting the anvil 7.

It will be apparent from the foregoing that, in principle, the gas pressure in the chamber 3 could be nil at the beginning (i.e. no precompression of the gas) leading to the stroke diagram of FIG. 7, for example. This principle is embodied in FIG. 14 which shows a separate body 8'' having an opening 16a in the side wall of the chamber through which gas can enter into the chamber 3 through a non-return valve 17. Even if a seal 18 on the strike cap piston 3a is not fully gas tight, there would not be any underpressure or cavitation since a spring 19 interposed between the top of the strike cap piston 3a and top wall of the chamber 3 brings the strike cap piston 3a back into the illustrated position and the body 8'' back into its starting position before the next blow and by doing so, outside air is drawn into the chamber 3 through the non-return valve 17 and through the opening 16a. Alternatively, the opening 16a and non-return valve could be connected to a gas container or to a pump to supply gas or air to the chamber 3. Whether or not the separate body 8'' can be incorporated in the dropweight or used as such as the resilient impact transmitting buffer means depends largely on the frequency of blows per minute which is high in pile driving and the compression ratio of the gas. Thus, the separate body 8'' is more suitable for use in absorbing rebounce forces. According to a feature of the invention, a number of these separate bodies 8'' may be located in the pile driving apparatus in such a way that they act as shock absorbing means and absorb the rebounce forces. For example in the embodiment of FIG. 13 a plurality of separate bodies 8'' may be arranged in a circular array at 20 in which case the gas pressure and/or arrangement of parts would be such that the separate body 8' delivers the full impact force to the pile. It will be appreciated that such a construction enables the impact force to be delivered and rebounce forces to be absorbed independently of each other.

Figure 15:
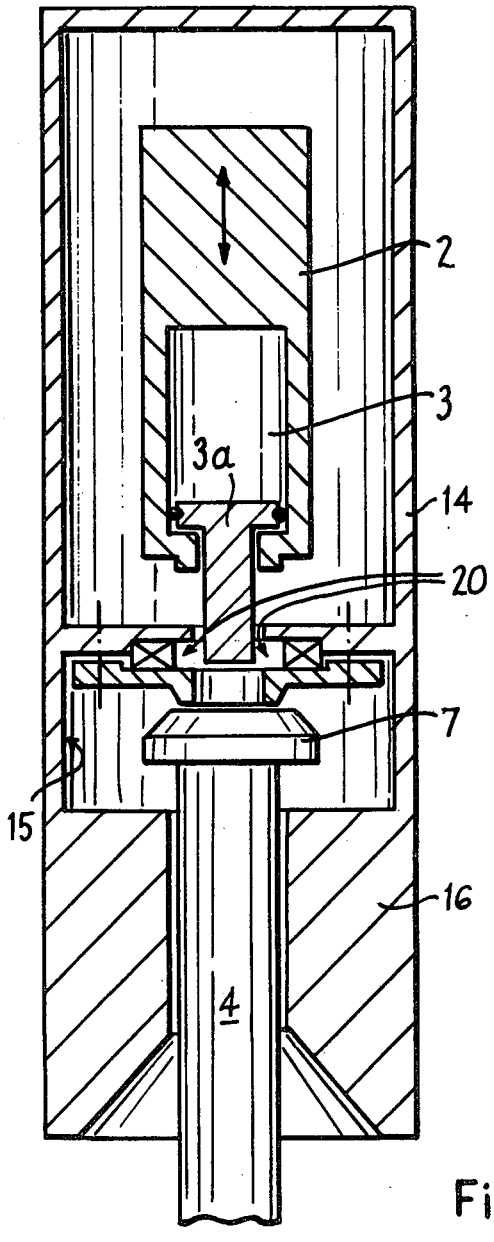
FIG. 15 is a section of a pile driving apparatus incorporating shock-absorbing means.
Figure 16:
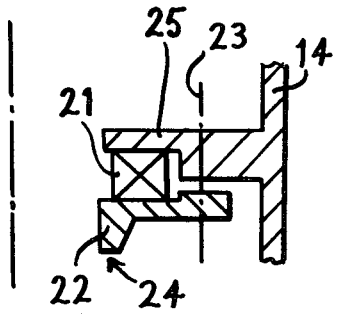
FIG. 16 is a scrap view to an enlarged scale of the apparatus of FIG. 15.

A pile driving apparatus in which absorption of rebounce forces and delivery of impact forces are also achieved separately is shown in FIGS. 15 and 16 in which resilient shock absorbing means 21 of any appropriate nature are arranged in a circular array at 20 in a recess in the bottom end of the housing 14. A ring 22 closes the recess and retains the resilient means 21 under compression against a plate 25 of the housing 14 by means of bolts 23 shown diagrammatically. The value of compression of these shock absorbing means 21 is such that it ideally absorbs the rebounce forces which are not therefore fully transmitted to the housing 14 of the ram or dropweight 2. Normally, when not driving, or in between successive driving blows, the housing 14 rests via the anvil 7 on the pile 4 through a ridge 24 which is integral with or secured to the ring 22. During pile driving, rebounce forces are led from the pile 4 through the anvil 7 to the ridge 24 where they are absorbed by the shock-absorbing means.

The shock absorbing means may be rubber blocks for example, or a number of separate bodies 8'' such as is shown in FIG. 14, which are connected to a plate 25 (FIG. 16) of the housing 14. When the separate bodies 8'' form the shock absorbing means 21, the ring 22 and bolts 23 may be omitted.

It will be appreciated that various modifications may be made without departing from the scope of the invention.

I claim:

1. A pile driving apparatus comprising a hammer for delivering an impact force to a pile, a housing having a bottom end, said hammer being mounted for movement within said housing, a pile sleeve extending downwardly from the bottom end of the housing for guiding the apparatus onto and receiving the top of a pile to be driven, a pile anvil, means holding said pile anvil captive within said pile sleeve for limited movement therealong, resilient impact transmitting buffer means disposed in the path of travel of the hammer for transmitting the impact force of the hammer to the pile anvil, said buffer means comprising a precompressed gas in a closed chamber defined by wall means and a strike piston movable therein for transmitting the impact force of the hammer through the gas to the pile, and resilient shock absorbing means separate from the hammer and interposed between the bottom end of the housing and the pile anvil and being precompressed to a lesser degree than the buffer means.

2. Pile driving apparatus comprising a hammer for delivering an impact force to a pile, a housing having a bottom end, said hammer being mounted for movement within said housing, a pile sleeve extending downwardly from the bottom end of the housing for guiding the apparatus onto and receiving the top of a pile to be driven, a pile anvil, means holding said pile anvil captive within said pile sleeve for limited movement therealong, resilient shock absorbing means separate from the hammer and being interposed between the bottom end of the housing and the pile anvil, said shock absorbing means being disposed in the path of travel of the hammer in addition to being interposed between the bottom end of the housing and the pile anvil and consisting in a shock absorbing device which is held captive in said pile sleeve for limited movement therealong and which comprises precompressed gas in a closed chamber defined by wall means and containing a strike piston projecting from the chamber and engaging the pile anvil, and stop means comprising one of the chamber wall means and the combination of the chamber wall means with the strike piston for cutting out the resilient effect of said precompressed gas after a predetermined extent of movement to deliver a non-resilient blow to the pile anvil.

3. Pile driving apparatus as claimed in claim 1, wherein said resilient impact transmitting buffer means is incorporated in a body which is separate from the hammer and interposed between said shock absorbing means and the pile anvil.

4. Pile driving apparatus as claimed in claim 3, wherein the said shock absorbing means comprises a plurality of shock absorbing devices each comprising wall means defining a chamber for receiving a gas and a piston which normally projects from said chamber and engages said body.

5. Pile driving apparatus as claimed in claim 1, wherein said resilient impact transmitting buffer means is incorporated in the hammer, and said shock absorbing means comprises shock absorbing devices of resilient material disposed in circular array around the bottom end of the housing and means holding the resilient material in compression against the bottom end of the housing.

6. Pile driving apparatus as claimed in claim 5, wherein said means holding the resilient material in compression comprises a ring member and means fixing said ring member to the bottom end of the housing with the resilient material therebetween, and ridge means projecting downwardly from said ring member for engagement with the pile anvil.

7. Pile driving apparatus as claimed in claim 1, and including means for adjusting the compression of the shock absorbing means.

* * * * *